US007037039B1

(12) United States Patent
Werts

(10) Patent No.: US 7,037,039 B1
(45) Date of Patent: May 2, 2006

(54) METHOD AND APPARATUS FOR AN IMPROVED LOCK AND DAM ASSEMBLY

(75) Inventor: R. Kelley Werts, Russell, IA (US)

(73) Assignee: Johnson Machine Works, Inc., Chariton, IA (US)

( * ) Notice: Subject to any disclaimer, the term of this patent is extended or adjusted under 35 U.S.C. 154(b) by 123 days.

(21) Appl. No.: 10/885,249

(22) Filed: Jul. 6, 2004

(51) Int. Cl.
*E02B 7/40* (2006.01)

(52) U.S. Cl. ..... 405/99; 405/87; 405/85

(58) Field of Classification Search ..... 405/99, 405/87, 92, 94, 85; 256/73, 12.5, 13.1
See application file for complete search history.

(56) References Cited

FOREIGN PATENT DOCUMENTS

| | | | |
|---|---|---|---|
| EP | 0412652 A2 | * | 2/1991 |
| FR | 2650028 A1 | * | 1/1991 |
| JP | 61237714 A | * | 10/1986 |
| JP | 03176507 A | * | 7/1991 |
| JP | 06108446 A | * | 4/1994 |

* cited by examiner

*Primary Examiner*—Frederick L. Lagman
(74) *Attorney, Agent, or Firm*—McKee, Voorhees & Sease, P.L.C.

(57) ABSTRACT

A method of assembling a lock and dam system is disclosed to minimize the rate of structural fatigue associated with closing of the lock and dam system. The lock and dam system includes one or more gates that may include a plurality of girders, plates and associated support or reinforcing members. The gate has a miter end and a quoin end. On the miter end a miter block, and thrust plate transfer impact forces associated with closing of the gate from the point of impact to the remainder of the gate. The thrust plate is preferably a substantially uniformly thick member that is secured vertically to the gate through a slot cut or formed in the end of the horizontal plate on the miter and quoin end. Preferably, the thrust plate is secured using a fillet weld.

15 Claims, 4 Drawing Sheets

METHOD AND APPARATUS FOR AN IMPROVED LOCK AND DAM ASSEMBLY

BACKGROUND OF THE INVENTION

The present invention relates generally to a method of building miter gates within a lock and dam system and more particularly to a method of construction that reduces the rate of structural fatigue associated with use of the miter gates within the lock and dam system.

1. Status of the Art

Miter gates have been in use throughout the United States for a number of years. Typically made of steel, these gates within the lock and dam systems, provide ways for boat and barge traffic to safely navigate controlled water ways.

A controlled water way, such as the Mississippi river, may have several lock and dam systems along its route. When in a locked position, the system blocks water upstream from flowing downstream and thus allows a controller, such as the Army Corp of Engineers, to raise and lower the water level as required. After proper adjustment, the system can be opened to allow for water traffic to pass.

After all traffic has cleared, the miter gate system is closed. Closing the system requires a great deal of force. The closing process ends with a great amount of stress being applied to the end of the miter gate system during the closing impact. This stress is transferred from the closing or miter end, to the pivot or quoin end of the system.

Traditionally, a miter gate is composed of a series of diaphragms supported by network of girders, stiffeners and other support members. When the closing impact occurs, the impact stress must be absorbed at the miter end, transferred down the network of girders and dissipated in the ground at the quoin end. The initial impact forces are currently absorbed by the cross-sectional area of a series of vertical thrust plates and the horizontal web plates they are secured between. Because the thrust plates are secured to the web plates in sections and welded in place to the web plates using a T-joint weld, the stress tends to flow into the web plates creating destructive strains.

Because the miter gate will go through many opening and closing operations during its useful life, the resultant cyclical loading strains in the web plates causes linear cracking over time. The cracking, or laminar tearing, detrimentally affects the useful life of the miter gate system. There is therefore a need for a method of making a miter gate system that will reduce the destructive cracking resulting from the strains associated with the closing impact.

A common method of reducing strain is to pre-stress materials. Pre-stressing the thrust plate, web plate and girder structures of a miter gate system would require pre-heating the structures, particularly their joining sections, to approximately the welding temperature and then slowly cooling the pieces. Not only would extensive pre-stressing add significantly to the construction costs, but because of the large sizes associated with nearly every miter gate system, such a pre-stressing process would also add significantly to the time needed for construction. Therefore, there is a need for a method of constructing the miter gate system which reduces destructive cracking in a cost effective and timely manner.

2. Features of the Invention

A general feature of the present invention is the provision of a method of constructing a miter gate system which overcomes the problems found in the prior art.

Another feature of the present invention is the provision of a method of constructing a miter gate system which prolongs the useful life of the system.

A further feature of the present invention is the provision of a method of constructing a miter gate system which reduces closing impact related cracking.

A still further feature of the present invention is the provision of a method of constructing a miter gate system which is cost-effective.

Another feature of the present invention is the provision of a method of constructing a miter gate system which keeps construction time reasonable.

These, as well as other features and advantages of the present invention, will become apparent from the following specification and claims.

SUMMARY OF THE INVENTION

The present invention generally comprises a method of constructing a miter gate system that uses a girder, stiffener and web plate grid structure to support a plurality of diaphragms. More specifically, the present invention includes securing the vertical thrust plates to the girder, stiffener and web plate grid support structure by forming a slot in the web plates on the quoin and miter ends of the gate. The series of thrust plates are welded to one another to act as one and are inserted into the groove of the end web plates. In the groove or slot, the thrust plates are fillet welded to the web plate to secure the thrust plate assembly in place. Such an assembly process allows the thrust plates to transfer the impact stresses associated with closing directly to the girder, stiffener and web plate grid support structure which transfers the stresses to the thrust plates on the opposite end and out to be dissipated in the ground. By providing a solid thrust plate arrangement, the closing impact stresses need not flow into the end web plate, thus minimizing strain in the web plate.

DETAILED DESCRIPTION OF THE PREFERRED EMBODIMENT

The present invention will now be described according to its preferred embodiment. It should be understood that the present invention is not limited to the embodiment described.

Figure 1:
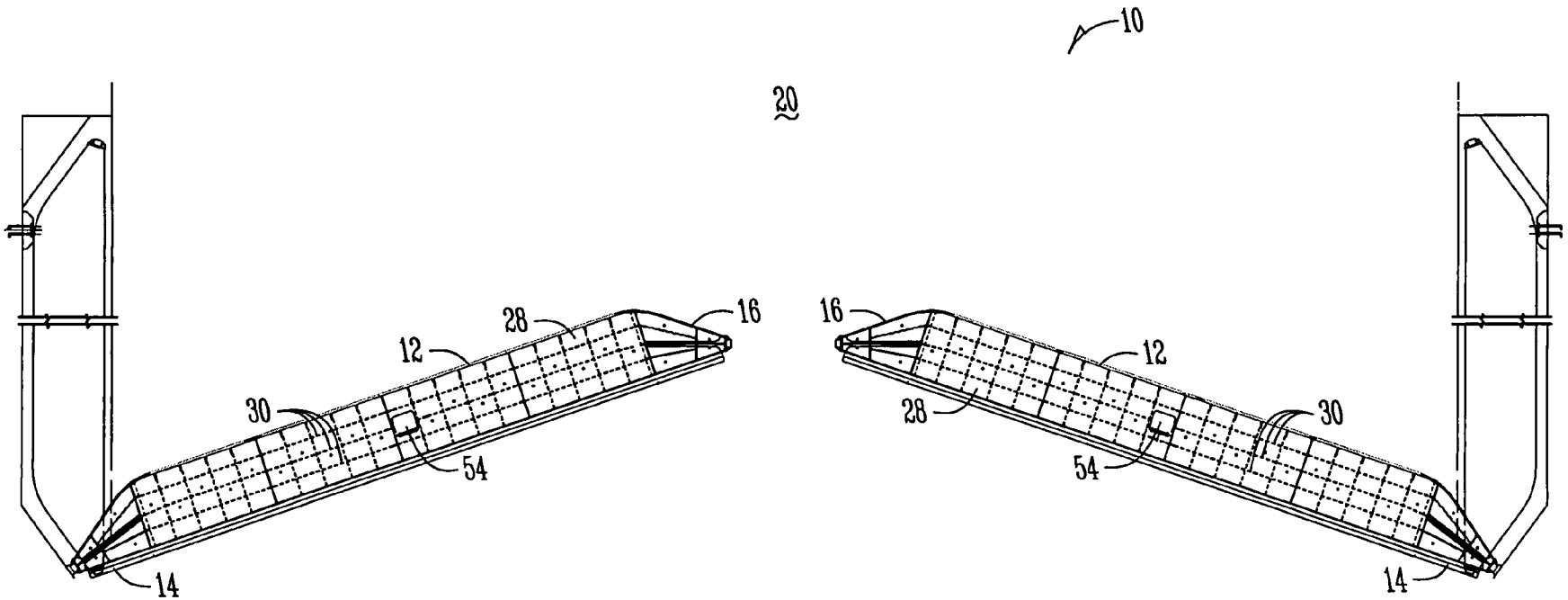
FIG. 1 is a top sectional view of the miter gates within the lock and dam assembly showing the system in a partially closed position.

As is shown in FIG. 1, the preferred lock and dam system 10 includes at least one, and usually a plurality of gates 12. The gates 12 have what are commonly referred to as a quoin end 14 and a miter end 16. In operation, the gates 12 rotate at the quoin end 14 and come together at the miter end 16. When the gates 12 come together, they block flow of water from the upstream location 20 to the down stream location 18 thereby allowing the controlling authority, typically a unit of the Army Corps of Engineers, to control the level of water in the lock and dam system 10.

Each gate 12 in the lock and dam system is typically made of a number of elements. Most of the elements are preferably A709 Gr. 50 steel. For example, a typical gate 12 includes a number of girders 22 assembled through welding and other means. The girders 22 are secured with a plurality of girder web plates 28 which are preferably either ⅝" or ¾" thick. Preferably, all welding is done using 100% CO2 gas with .045" electrodes at 28 V and 180–200 Amps or a .052" electrode at 26–27 V and 200–220 Amps. Occasionally, a 150 degree Fahrenheit preheat and interpass temperature is applied and maintained. Filler metal, such as Lincoln Outershield 71M, can also be used for this application.

Figure 2A:
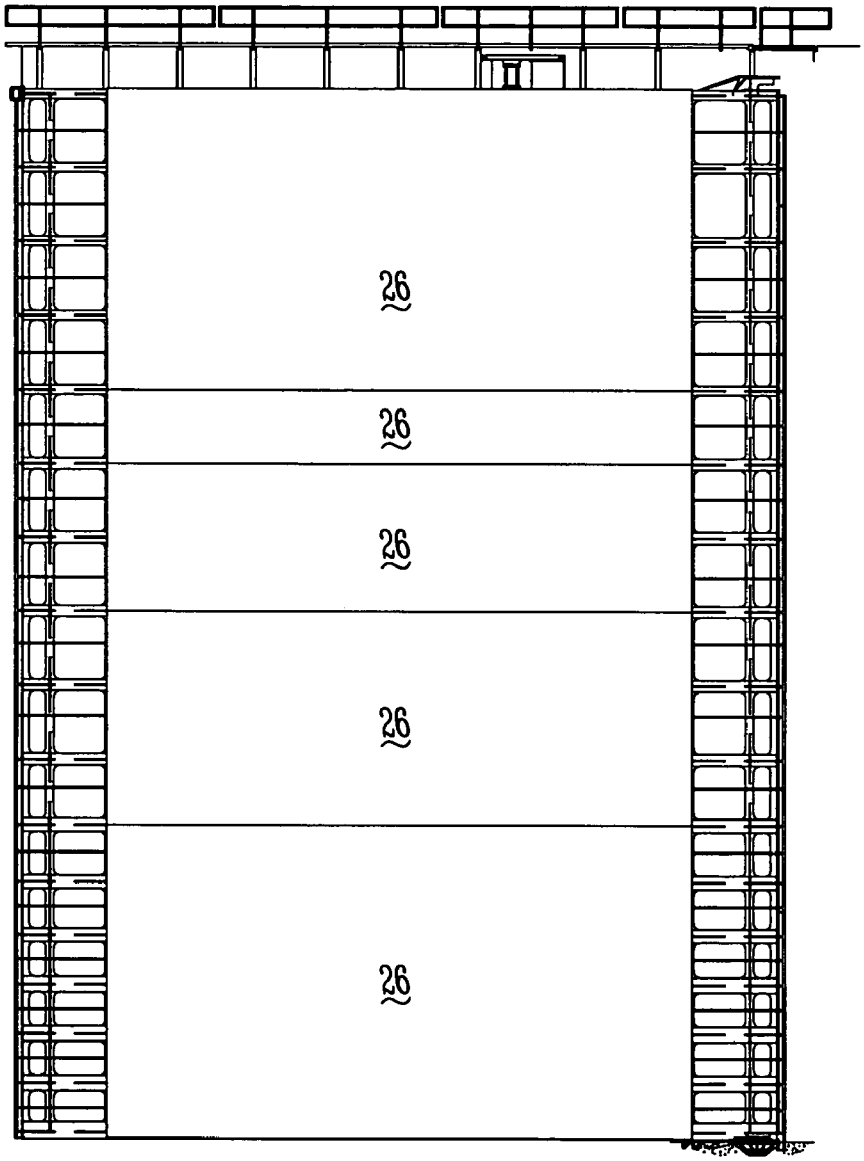
FIG. 2A is an upstream elevation view of one of the gates of the lock and dam assembly.
Figure 2B:
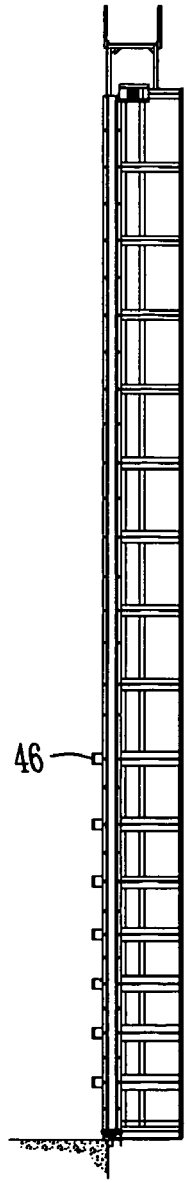
FIG. 2B is a side view of the gate of the lock and dam assembly shown in FIG. 2A.
Figure 3A:
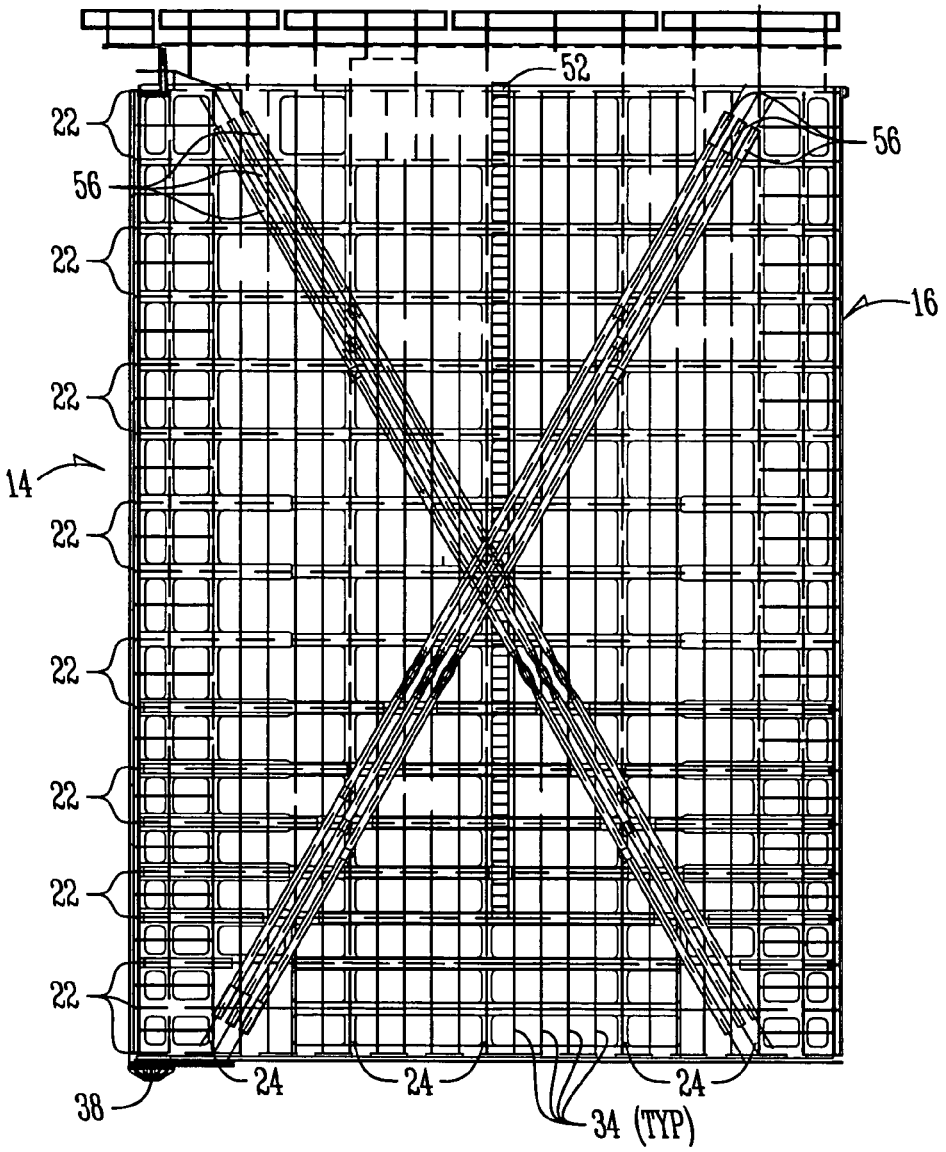
FIG. 3A is a downstream elevation view of one of the gates of the lock and dam assembly.
Figure 3B:
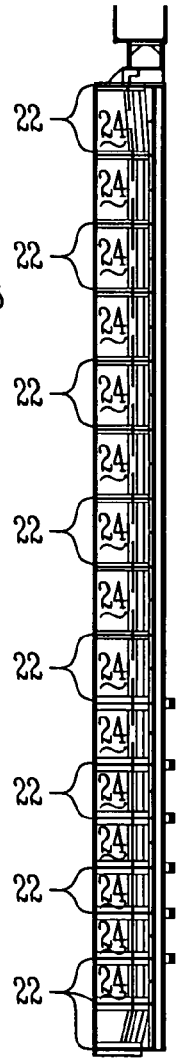
FIG. 3B is a side view of the gate of the lock and dam assembly shown in FIG. 3A.

When assembled the components of a typical gate 12 include the girders 22, diaphragm plates 24, skin plates 26 as shown in FIGS. 2A and 2B and the girder web plates 28. Typically the diaphragm plates 24 run vertically between the girders 22. These plates are all secured to the girders 22 through welding or other means and together form the gate 12 that allows the controlling authority to control water levels within the lock and dam system 10. The system 10 is-reinforced with longitudinal stiffeners 30, transverse stiffeners 32, intercostals 34 and diagonal supports 56. The gate 12 may also include a ladder 52 that travels through a plurality of ladder holes 54 that are formed in the girder web plates 28.

Figure 5:
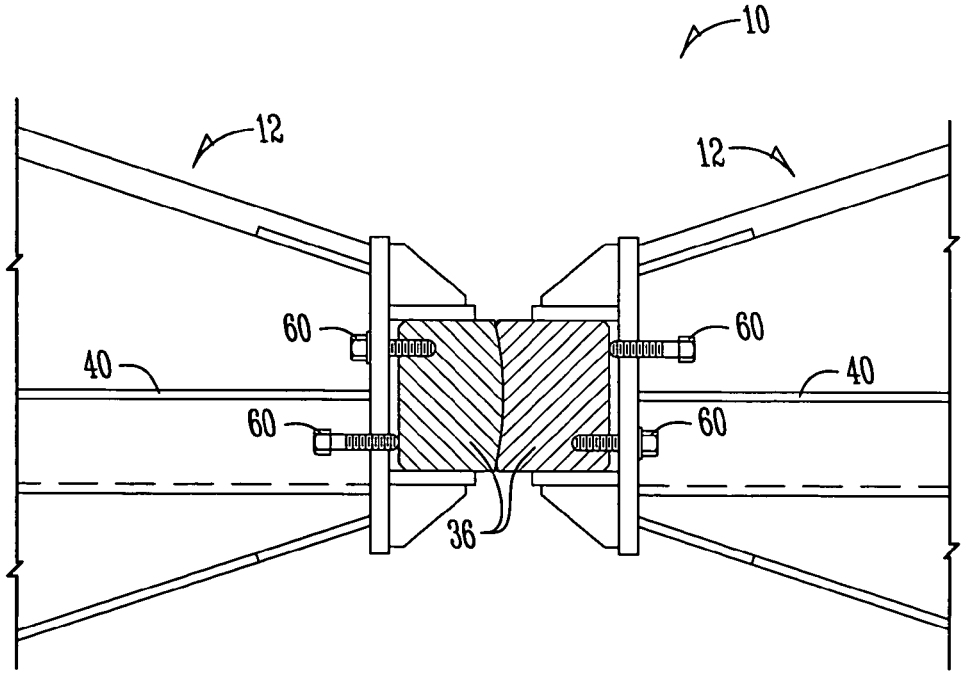
FIG. 5 is a sectional view of the miter ends of each of the gates shown in FIG. 1 shown in the closed position.

The gate 12 rotates at the quoin end 14 on a pintle 38 as is well known in the art. On the opposite end, the gates 12 come together at a miter block 36 as is shown in FIG. 5. Preferably, the miter block 36 is A276 stainless steel in its lower, water covered portion, and A36 steel above. The positioning of the miter blocks 36 is adjustable via a plurality of adjustment screws 60.

Figure 4:
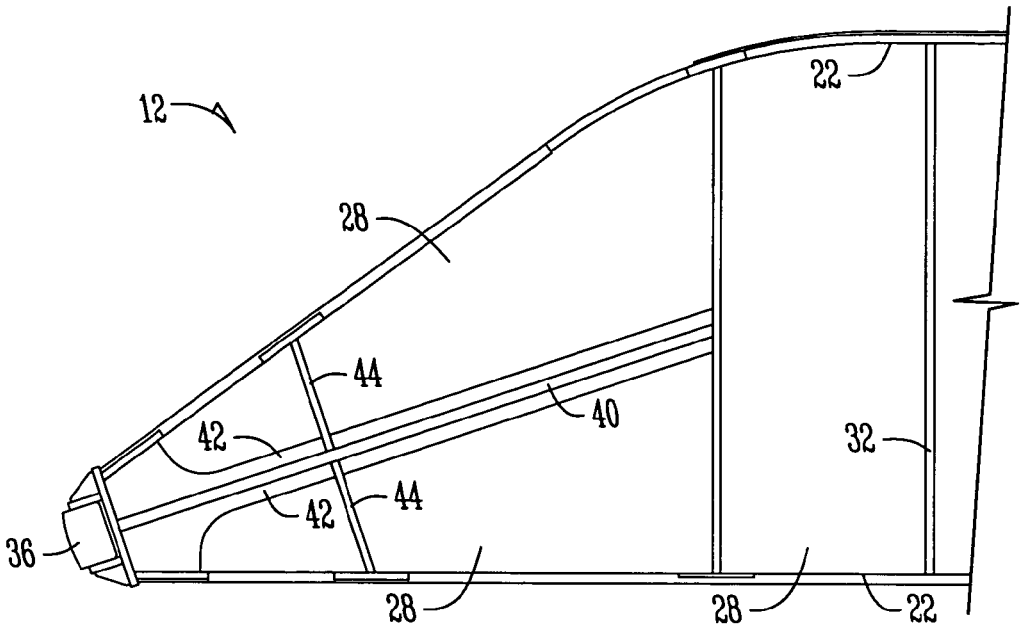
FIG. 4 is a sectional view of section A shown in FIG. 1.

However, even with the miter block 36, a significant amount of impact stress is transferred to the gate 12 during closing contact with the opposite gate 12. Each gate 12 must be capable of withstanding the stresses associated with closing and transfer the resultant strains across the girder and plate system and into the land. Most of the stress is absorbed through the miter block 36 and transferred along the girders 22 and plates 23, 26 and 28 of the gate 12. Initially however, all of the stress must be absorbed by a primary vertically aligned plate known as a thrust plate 40. The thrust plate 40 runs vertically along the height of the gate 12. As is shown in FIG. 4, the thrust plate 40 is the plate that contacts the miter block 36.

Upon closing of the gates 12, the stresses from closing are sent through the thrust plate 40. Prior assembly methods have left the thrust plate with inherent weaknesses which allowed for linear cracking in either the thrust plate or the girder plate when the stresses caused strains which the plates could not handle. To minimize linear cracking, the present invention allows the thrust plate 40 to absorb and transfer the stresses to the remainder of the girders 22 and plates 24, 26, and 28. This is accomplished by cutting a slot in the girder web plate 28 through which the thrust plate 40 will fit and then welding the thrust plate 40 to the girder web plate 28 with a fillet weld. Preferably, the slot provides a 1/16" clearance on each side of the thrust plate 40. Of course, the thrust plate 40 may be made in several sections and assembled prior to or during construction of the gate 12. Additional reinforcing structures can be added, such as longitudinal thrust plate stiffener 42 and a transverse thrust plate stiffener 44 can be used to enhance the rigidity and stability of the thrust plate 40.

A general description of the present invention as well as a preferred embodiment to the present invention has been set forth above. Those skilled in the art to which the present invention pertains will recognize and be able to practice additional variations in the methods and systems described which fall within the teachings of this invention. Accordingly, all such modifications and additions are deemed to be within the scope of the invention which is to be limited only by the claims appended hereto.

What is claimed is:

1. A method of constructing a miter gate assembly, the method comprising:

assembling a plurality of horizontal girders, girder web plates and vertical diaphragm plates to form a gate terminating in a quoin end and a miter end;

forming a slot in the girder web plate on the miter and quoin ends, inserting a thrust plate into the slot; and welding the thrust plate to the girder web plate.

2. The method of constructing a miter gate assembly of claim 1 wherein welding is done by using a fillet weld.

3. The method of constructing a miter gate assembly of claim 1 wherein the gate is reinforced with longitudinal stiffeners.

4. The method of constructing a miter gate assembly of claim 1 wherein the gate is reinforced with transverse stiffeners.

5. The method of constructing a miter gate assembly of claim 1 wherein the thrust plate is made from a plurality of separate thrust plates welded together.

6. The method of constructing a miter gate assembly of claim 5 wherein the thrust plates are welded together using a butt weld.

7. The method of constructing a miter gate assembly of claim 5 wherein the thrust plates are welded together before being inserted into the slot.

8. The method of constructing a miter gate assembly of claim 5 wherein the thrust plates are welded together after being inserted into the slot.

9. The method of constructing a miter gate assembly of claim 5 wherein the thrust plates are welded together during assembly of the gate.

10. A miter gate system that minimizes the rate of structural fatigue, the miter gate system comprising:

a gate having a miter end and a quoin end, the gate including a plurality of girders, a plurality of diaphragm plates operatively connected to the girders in a vertical orientation, a plurality of girder web plates operatively connected to the girders in a horizontal direction, a slot formed in the girder web plates on the miter and quoin ends, and a thrust plate that traverses through the girder web plates through the slot.

11. The miter gate system of claim 10 wherein the thrust plate includes a plurality of thrust plates secured together.

12. The miter gate system of claim 11 wherein the thrust plates are secured to one another with a butt splice weld.

13. The miter gate system of claim 10 wherein the thrust plate is secured to the girder web plate on the miter and quoin ends with a fillet weld.

14. The miter gate system of claim 10 wherein the gate further includes stiffeners.

15. A method of routing applied forces through a lock and dam gate, the method comprising:

providing a gate with a series of girders and plates that terminates with a thrust plate, the miter wherein the thrust plate does not substantially vary in thickness;

closing the gate and transferring any forces associated with closing through the thrust plate and into remaining girders and plates for dissipation.

* * * * *